US007152702B1

(12) United States Patent
Bhome et al.

(10) Patent No.: US 7,152,702 B1
(45) Date of Patent: Dec. 26, 2006

(54) MODULAR SYSTEM FOR A BACK REAMER AND METHOD

(75) Inventors: Amol Bhome, Ponca City, OK (US); Robert H. Slaughter, Ponca City, OK (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 11/267,017

(22) Filed: Nov. 4, 2005

(51) Int. Cl.
*E21B 10/633* (2006.01)
*E21B 10/28* (2006.01)
*E21B 10/42* (2006.01)
*B23D 77/00* (2006.01)

(52) U.S. Cl. ..... 175/384; 175/413; 175/406; 408/186

(58) Field of Classification Search ..... 175/344, 175/356, 357, 366, 53, 62, 406, 384, 413; 408/186, 189, 199
See application file for complete search history.

(56) References Cited

U.S. PATENT DOCUMENTS 5,560,440 A * 10/1996 Tibbitts ..... 175/384
6,609,580 B1 * 8/2003 Beaton ..... 175/406
6,729,418 B1 * 5/2004 Slaughter et al. ..... 175/53
6,902,014 B1 * 6/2005 Estes ..... 175/266

* cited by examiner

*Primary Examiner*—David Bagnell
*Assistant Examiner*—Robert E Fuller
(74) *Attorney, Agent, or Firm*—Osha Liang LLP

(57) ABSTRACT

A modular back reamer to be used in subterranean drilling includes a drive stem, a reamer body having a plurality of receptacles, wherein the receptacles are configured to retain a cutting leg assembly, and a plurality of shims engaged within the receptacles to secure the cutting leg assemblies at a specified height.

32 Claims, 19 Drawing Sheets

MODULAR SYSTEM FOR A BACK REAMER AND METHOD

BACKGROUND OF INVENTION

1. Field of the Invention

The invention relates generally to directional drilling. More particularly, the invention relates to back reamers used in horizontal directional drilling. More particularly still, the invention relates to a modular back reamer capable of being configured to a variety of drilling diameters for use in horizontal directional drilling.

2. Background Art

Horizontal directional drilling ("HDD") is a process through which a subterranean bore is directionally drilled in a substantially horizontal trajectory from one surface location to another. Typically, HDD operations are used by the utilities industry to create subterranean utility conduits underneath pre-existing structures, but any application requiring a substantially horizontal borehole may utilize HDD. Frequently, HDD bores are drilled to traverse rivers, roadways, buildings, or any other structures where a "cut and cover" methodology is cost prohibitive or otherwise inappropriate.

During a typical HDD operation, a horizontal drilling rig drives a drill bit into the earth at the end of a series of threadably connected pipes called a drill string. As the operation is substantially horizontal, the drilling rig supplies rotational (torque on bit) and axial (weight on bit) forces to the drill bit through the drill string. As the drill bit proceeds through the formation, additional lengths of drill pipe are added to increase the length of the drill string. As the drill string increases in flexibility over longer lengths, the drill string can be biased in a predetermined direction to direct the path of the attached drill bit. Thus, the drilling is "directional" in that the path of the bit at the end of the drill string can be modified to follow a particular trajectory or to avoid subterranean obstacles.

Typically, HDD operations begin with the drilling of a small "pilot" hole from the first surface location using techniques described above. Because of the diminished size in relation to the final desired diameter of the borehole, it is much easier to directionally drill a pilot bore than a full-gage hole. Furthermore, the reduced size of the pilot bit allows for easier changes in trajectory than would be possible using a full-gage bit. At the end of the pilot bore, the drill string emerges from the second surface location, where the pilot bit is removed and a back reamer assembly is installed. Usually, the back reamer assembly is a stabilized hole opener that is rotated as it is axially pulled back through the pilot bore from the second surface location to the first surface location. The drilling rig that supplied rotary and axial thrusting forces to the pilot bit during the drilling of the pilot bore supplies rotary and axial tensile forces to the back reamer through the drill string during the back reaming. Preferably, the stabilizer of the back reamer is designed to be a close fit with the pilot bore so the back reamer follows as close to the pilot bore trajectory as possible.

Formerly, back reamers were large, custom-built assemblies that were fabricated, assembled, and welded together to suit a particular job and subsequently discarded when the job was finished or the reamer was damaged. Because each job was substantially unique, there was little benefit in retaining the reamers after the job was completed. Furthermore, because each job-specific back reamer was only configured to drill one hole size, custom, one-shot fabrication was preferred over maintaining a large inventory of varied sizes and configurations.

Over time, numerous attempts to create re-configurable back reamers have been made. As a result, various concepts for back reamers having replaceable components (e.g. cutting arms, cones, and stabilizers) have been introduced to the market but with mixed results. Particularly, HDD back reamers with replaceable cutters affixed to the reamer body through heavy welds. While the cutters are replaceable in theory, the welds must be broken and removed before replacement cutters can be installed. Other HDD back reamers are constructed as standard oilfield hole openers in that saddle-mounted cutters are employed. While the cutters are replaceable, there is no flexibility to change the type of cutters (e.g. rotating or drag) or the cutting diameter.

SUMMARY OF INVENTION

In one aspect of the present invention, a modular back reamer to be used in subterranean drilling includes a drive stem connected to a drill string and configured to support a reamer body. Preferably, the reamer body provides a plurality of receptacles, wherein the receptacles are configured to retain a cutting leg assembly at varying heights within a predetermined range. Preferably, a plurality of shims engaged within the receptacles secures the cutting leg assemblies at a specified height within the predetermined range.

In another aspect of the present invention, a modular back reamer to be used in subterranean drilling includes a drive stem having a load flange, a polygonal profile, and a connection to a drill string. Preferably, the load flange and polygonal profile are configured to abut and receive a replaceable reamer body, wherein the replaceable reamer body provides a plurality of receptacles, the receptacles retaining a plurality of cutting leg assemblies. Preferably, a plurality of shims are engaged within the receptacles adjacent to the cutting leg assemblies to secure the cutting leg assemblies at specified cutting heights therein. Preferably, a centralizer upon the drive stem is located adjacent to the connection to a drill string, wherein the centralizer is configured to direct the modular back reamer's trajectory along a pilot bore.

In another aspect of the present invention, a method to enlarge a pilot bore created in a formation through horizontal directional drilling into a final diameter includes selecting a drive stem having a first drilling range including the final diameter. Preferably, the method also includes selecting a reamer body having a second drilling range including the final diameter and selecting a plurality of cutting leg assemblies having a third drilling range including the final diameter. The method preferably includes installing shims and the cutting leg assemblies into receptacles of the reamer body to define a cutting gage equal to the final diameter. The method preferably includes attaching a centralizer ahead of the reamer body and cutting leg assemblies, wherein the centralizer configured to engage the pilot bore and applying torque and axial force to the drive stem to engage and cut the formation along a trajectory of the pilot bore.

Other aspects and advantages of the invention will be apparent from the following description and the appended claims.

DETAILED DESCRIPTION

Figure 1:
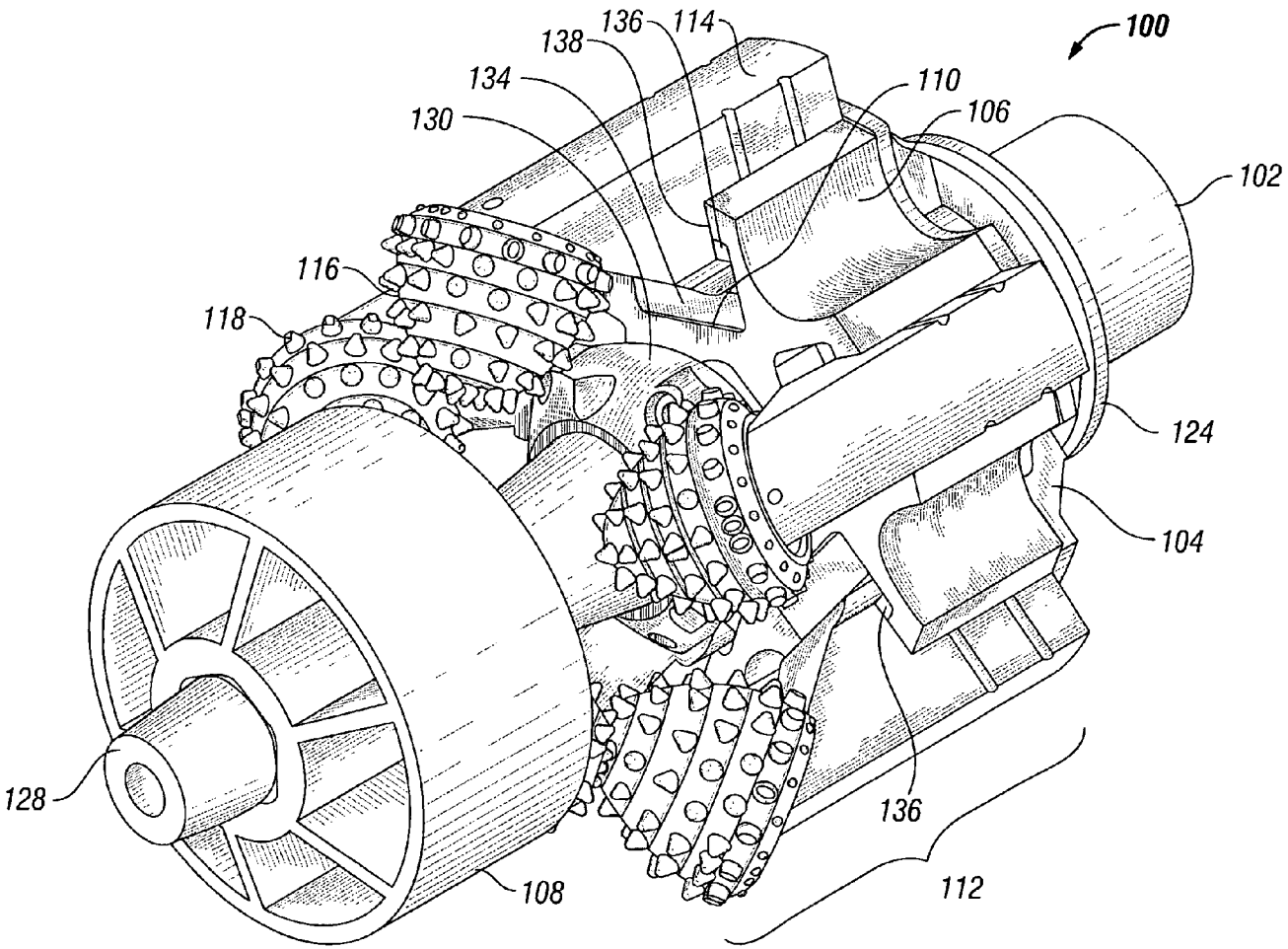
FIG. 1 is a perspective-view drawing of a back reamer assembly in accordance with an embodiment of the present invention.
Figure 2:
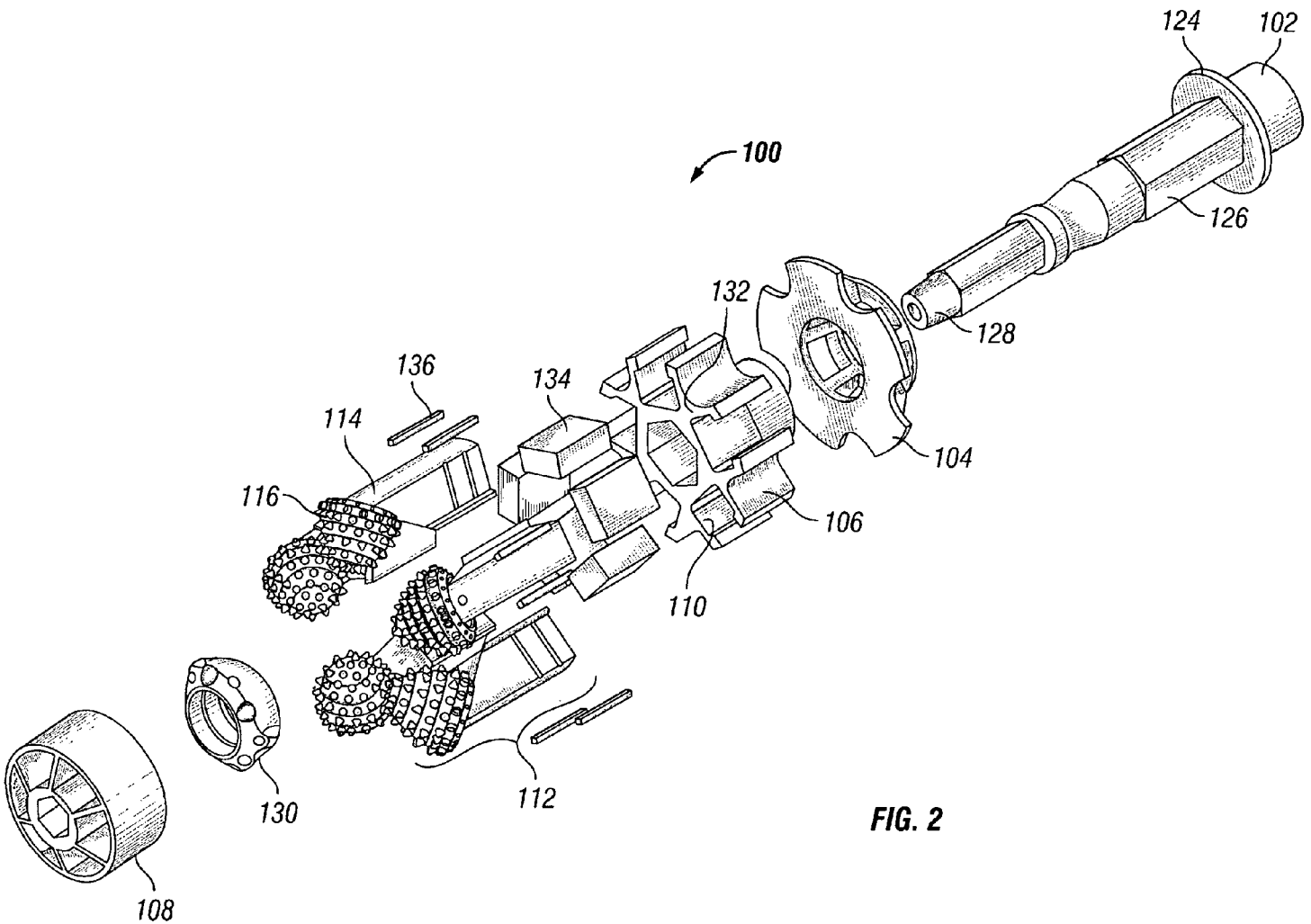
FIG. 2 is an exploded-view drawing of the back reamer assembly of FIG. 1.

Embodiments disclosed herein relate to a modular back reamer assembly for use in drilling. Referring initially to FIGS. 1 and 2 together, a modular back reamer assembly 100 is shown. FIG. 1 depicts back reamer assembly 100 in an assembled state and FIG. 2 depicts back reamer assembly 100 in an exploded state. As such, modular back reamer 100 as shown includes a drive stem 102 upon which a support plate 104, a main reamer body 106, and a centralizer 108 are mounted. Main reamer body 106, positioned between backing plate 104 and centralizer 108, includes a plurality of receptacles 110, in which a plurality of cutting leg assemblies 112 are mounted.

Figure 3:
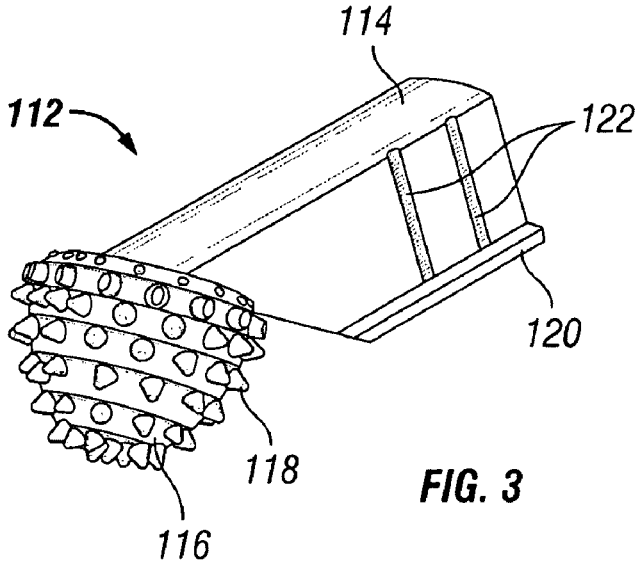
FIG. 3 is a perspective-view drawing of a cutting leg assembly of FIG. 1.

Referring briefly to FIG. 3, each cutting leg assembly 112 includes a cutter leg 114 and a cutter body 116 rotably depending therefrom. Upon the periphery of each cutter body 116 are a plurality of cutting elements 118. Cutting elements 118 can be of any geometry, design, and material appropriate for the formation to be drilled, but are typically constructed as either tungsten carbide insert ("TCI") elements, hardmetal coated milled tooth elements, or polycrystalline diamond compact cutters. While cutter body 116 is shown constructed as a cone-shaped roller cone similar to those used in vertical drilling applications, it should be understood that various designs and geometries for cutter body 116 can be used. Cutter leg 114 includes an upset ridge 120 on either side thereof. As will be described in further detail below, upset ridges 120 are constructed to prevent cutting leg assemblies 112 from being removed from their positions within receptacles 110 of main body 106 of FIGS. 1 and 2. Furthermore, cutter leg 114 includes a pair of cylindrical slots 122 on either side of cutter leg 114 for the insertion of taper pins (not shown) to prevent lateral (i.e. side-to-side or tangential) movement of cutter leg 114 in reaction to drilling forces.

Referring again to FIGS. 1 and 2 together, back reamer assembly 100 is constructed from a plurality of modular components secured upon drive stem 102. Drive stem 102 is shown having a load flange 124 at its distal end, a polygonal profile 126 along its length, and a threaded rotary drill string connection 128 at its proximal end. As back reamer 100 is typically pulled through a pilot bore as it cuts, load flange 124 transmits axial forces to cutting assemblies 112 while polygonal profile 126 transfers rotational forces to cutting assemblies 112. As back reamer assembly 100 is desirably a modular system, drive stem 102 is configured to accept a variety of component sizes and configurations thereupon.

As shown in FIGS. 1 and 2, the modular components of back reamer assembly 100 include support plate 104, main body 106, centralizer 108, cutting assemblies 112 and a hydraulic hub 130. Support plate 104 adapts main body 106 to load flange 124 of drive stem 102, and acts to transmit axial loads therebetween. Main body 106 functions to retain cutting assemblies 112 and transmit drilling forces thereto. Rotational forces are transferred from polygonal profile 126 of drive stem 102 to cutting assemblies 112 through a corresponding polygonal profile 132 of main body 106. Centralizer 108 functions to guide back reamer assembly 100 and maintain trajectory along the path of a pre-drilled pilot bore. Hydraulic hub 130 functions to direct cutting fluids from the bore of the drill string (including a bore of drive stem 102) to cutting elements 118 of cutter bodies 116. Those having ordinary skill will appreciate that the polygonal profile is used as a matter of convenience and that other geometries may be used.

Components of back reamer assembly 100 are described as "modular" components in that depending on the particularities of the job to be drilled, they can be swapped out or reconfigured to accommodate a variety of gauge sizes or geometries. Particularly, cutting leg assemblies 112 are configured to be retained within receptacles 110 of main body 106 at varying radial heights. Therefore, a combination of one set of cutting leg assemblies 112 with a single main body 106 can be configured to drill a range of borehole diameters. If a diameter outside the range is desired to be cut, either the cutting leg assemblies 112, the main body 106, or both may be replaced with a smaller or larger size. Similarly, different sized centralizers 108 can be used with back reamer assembly 100 if the size of the pilot bore to be followed changes. Furthermore, the modular construction of back reamer assembly 100 allows for different geometry and type cutting leg assemblies 112 to be used. FIGS. 1–3 disclose cutting leg assemblies 112 having roller cone cutter bodies 116, but it should be understood that different cutter configurations, including scraping cutters, can be used in conjunction with main body 106.

Referring still to FIGS. 1 and 2, a plurality of shims 134, 136 are used in conjunction with receptacles 110 of main body 106 to retain cutting leg assemblies 112 in radial position. Shims 134 are base shims positioned underneath cutter legs 114 between cutting leg assemblies 112 and receptacles 110 of main body 106. Base shims 134 prevent cutting leg assemblies 112 from retracting radially within receptacles 110. Upper shims 136 are positioned above upset ridges (120 of FIG. 3) on either side of cutter legs 114 between ridges (120 of FIG. 3) and receptacles 110. As can be seen, receptacles 110 include retainers 138 at their radial limits to prevent cutting leg assemblies 112 from escaping therefrom. Desirably, retainers 138 are dimensioned so as to allow the clearance of cutter legs 114 but not upset ridges 120. When installed within receptacles 110, upper shims 136 act as extensions of upset ridges 120, thereby preventing cutting leg assemblies from extending outward radially.

To retain cutting leg assemblies 112 at a desired height corresponding to a particular drilling diameter, base shims 134 and upper shims 136 are selected and installed to ensure the cutting leg assemblies 112 are securely retained at that height. Therefore, in typical applications, the minimum diameter for any particular cutting leg 112 and main body 106 include the thinnest shims 134 (or no shims at all) at the base of receptacle 110 in conjunction with the thickest shims 136 available at the top of receptacle 110. Conversely, the maximum diameter would include the thickest shims 134 at the base of receptacle 110 and the thinnest shims 136 (or no shims at all) at the top of receptacle 110. Again, such an arrangement is not required, but is a matter of convenience.

Figure 4:
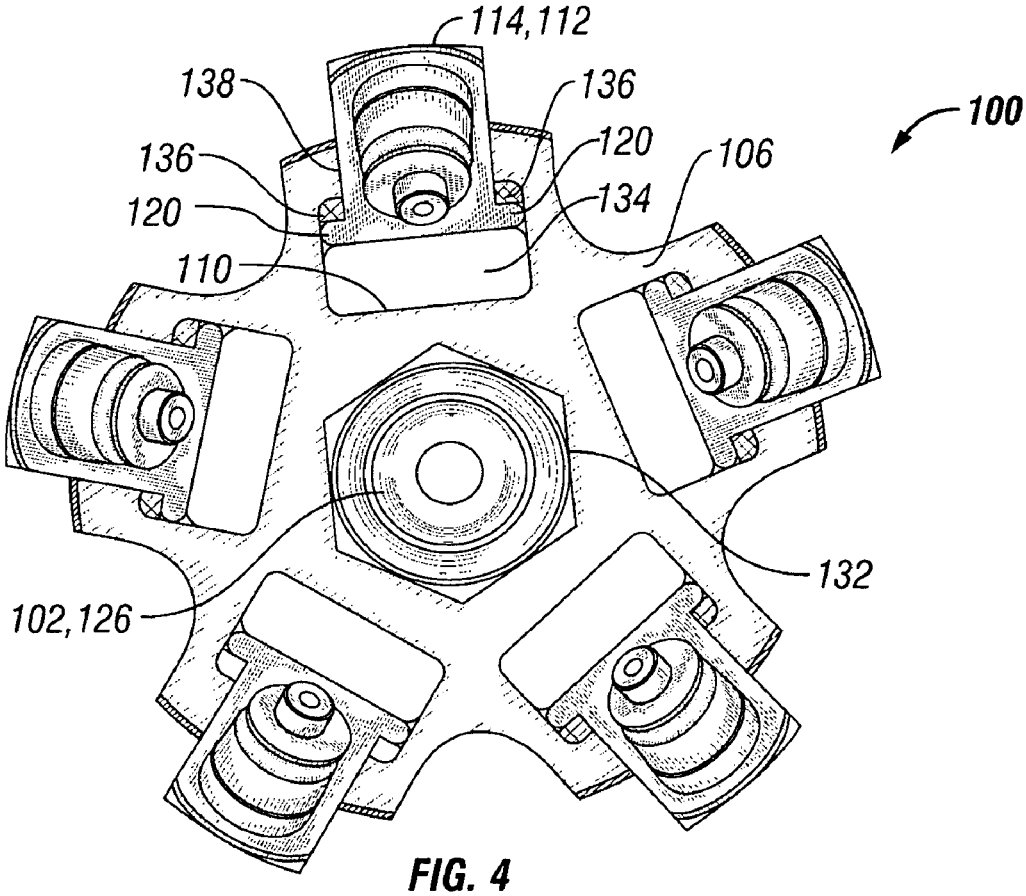
FIG. 4 is an end-view drawing of the back reamer assembly of FIG. 1 shown in a first configuration.
Figure 5:
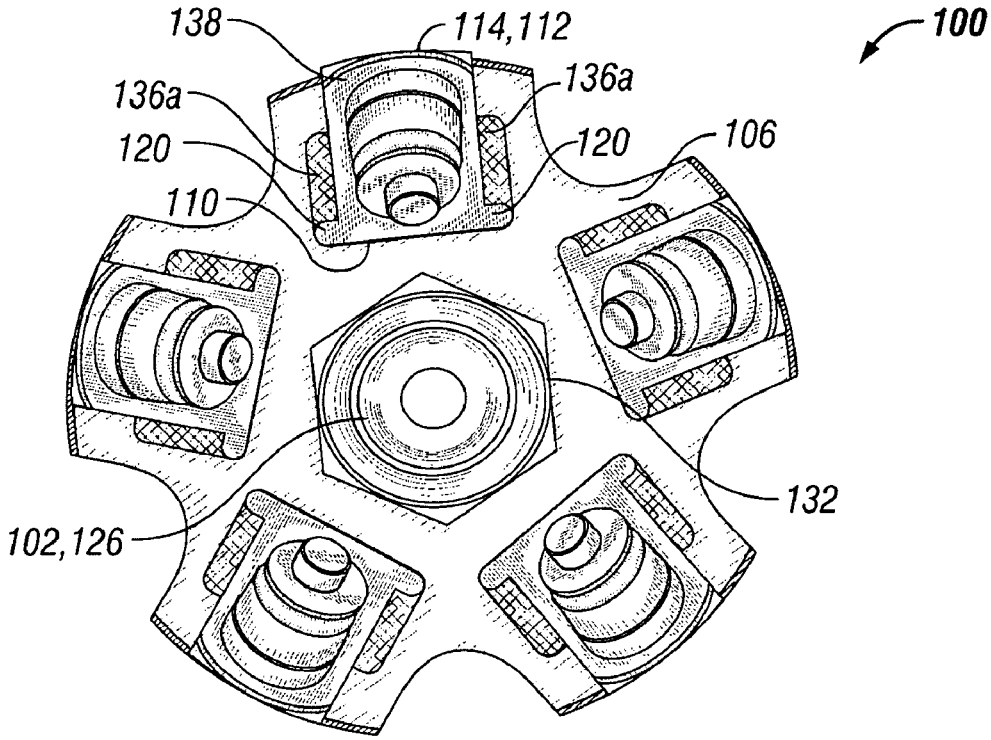
FIG. 5 is an end-view drawing of the back reamer assembly of FIG. 1 shown in a second configuration.

Referring briefly to FIGS. 4 and 5, a back reamer assembly 100 is shown as an end view of main body 106. For the purpose of visibility, FIGS. 4 and 5 are shown with cutter bodies 116 removed from cutting leg assemblies 112. As shown in FIG. 4, base shims 134 are installed in the bottom of receptacles 110 between main body 106 and cutting leg 114. Upper shims 136 are similarly installed in receptacle 110 between retainers 138 and upset ridges 120 of cutting leg 114. Therefore, upper shims 136 are placed above upset ridges 120 and on either side of cutting leg assemblies 112. When properly shimmed, cutting leg assemblies exhibit minimal or no radial "play" within their respective receptacles. Similarly, in referring briefly to FIG. 5, cutting legs 114 are shown retained within receptacles 110 at their minimum radial height. To accomplish this, no base shims are located between main body 106 and cutting leg 114, but maximum height upper shims 136 are located between upset ridges 129 and retainers 138.

Figure 6:
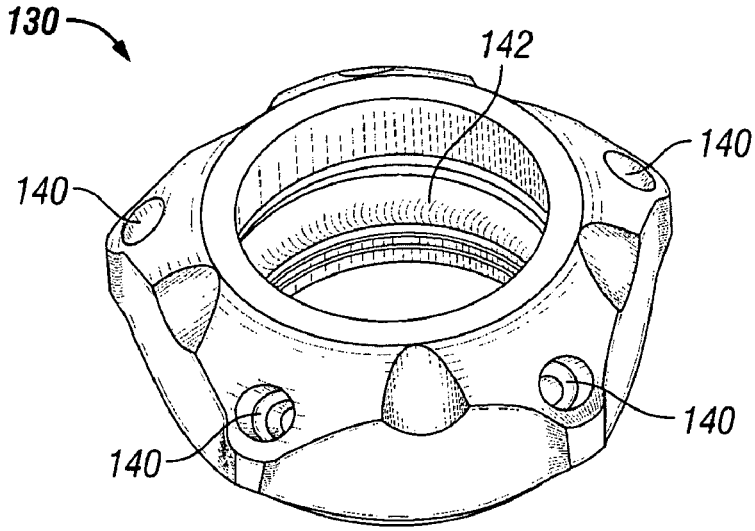
FIG. 6 is a perspective-view drawing of a hydraulic hub of the back reamer assembly of FIG. 1.
Figure 7:
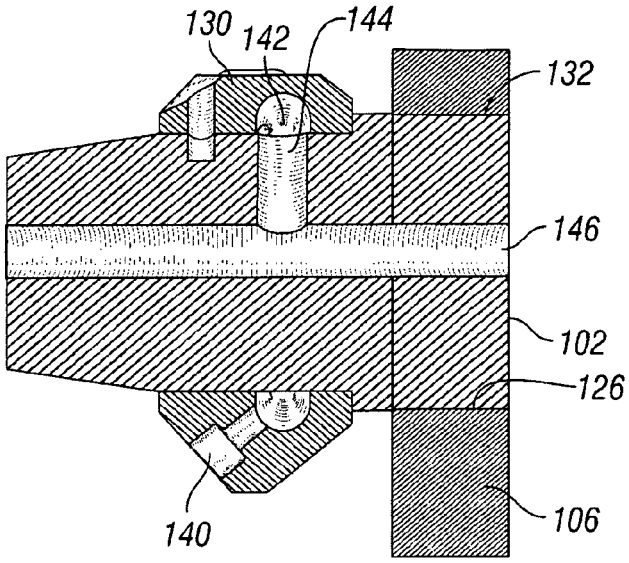
FIG. 7 is a section-view drawing of the hydraulic hub of FIG. 6 installed on the back reamer assembly of FIG. 1.

Referring now to FIGS. 6 and 7, hydraulic hub 130 is shown. As shown in FIGS. 1 and 2, hydraulic hub 130 is located proximal to and helps secure main body 106 against support plate 104 and load flange 124. As the forces of drilling typically thrust main body 106 against support plate 104 and load flange 124, hydraulic hub 130 primarily functions to direct drilling fluids from the bore of the drill string to the cutter bodies 116. Hydraulic hub 130 includes a plurality of fluid nozzles 140 in communication with a fluid passageway 142 within hub 130. Similarly, fluid passageway 142 is in communication with a fluid port 144 within drive stem 102. Fluid port 144 of drive stem 102 is likewise in communication with a fluid bore 146 of the drive stem, which in turn communicates with a bore of the drill string. When properly installed, fluid port 144 on the outer profile of drive stem 102 aligns with fluid passageway 142 of hydraulic hub 130 and drilling fluids flow through nozzles 140 to cutter bodies 116 from bore 146.

Figure 8:
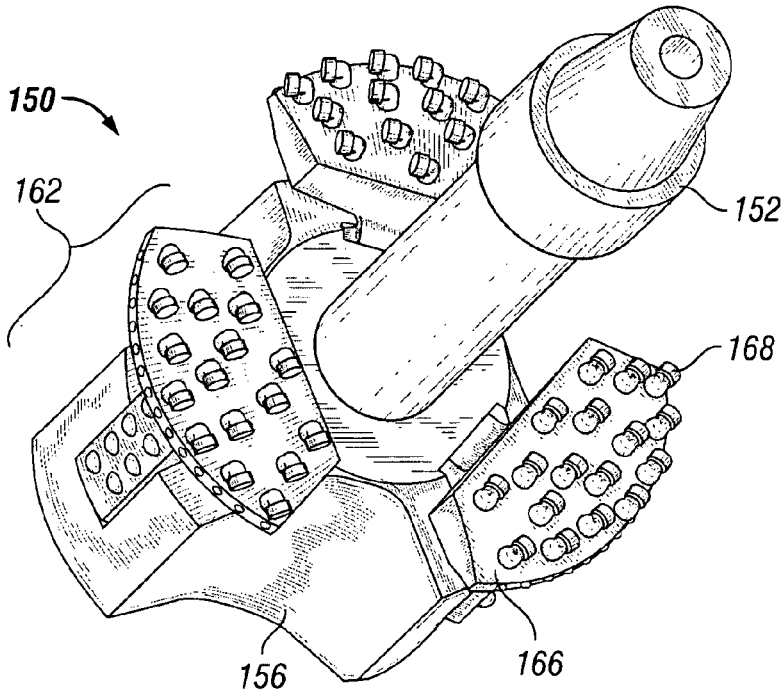
FIG. 8 is a perspective-view drawing of a back reamer assembly in accordance with an embodiment of the present invention.

Referring now to FIG. 8, an alternative embodiment for a modular back reamer assembly 150 is shown. Modular back reamer assembly 150 is similar to back reamer 100 of FIGS. 1–7, with the exception that scraper cutting leg assemblies 162 are used instead of roller cutting leg assemblies. Similarly, back reamer assembly 150 includes a drive stem 152 and a main body 156, wherein each scraper cutting leg assembly 162 is radially adjustable within main body 156. Scraper cutting leg assemblies 162 include a plurality of scraper cutting elements 168 aligned on a generally planar cutter body 166. In the example shown in FIG. 8, cutting leg assembly 162 includes a plurality of polycrystalline diamond compact ("PDC") cutters in a scraping arrangement upon cutter bodies 166. While back reamer assembly 150 shows only one alternative embodiment to cutting leg assemblies 112 of FIGS. 1 and 2, it should be understood that any number of different cutting schemes and structures can be used in conjunction with embodiments of the present invention.

Figure 9:
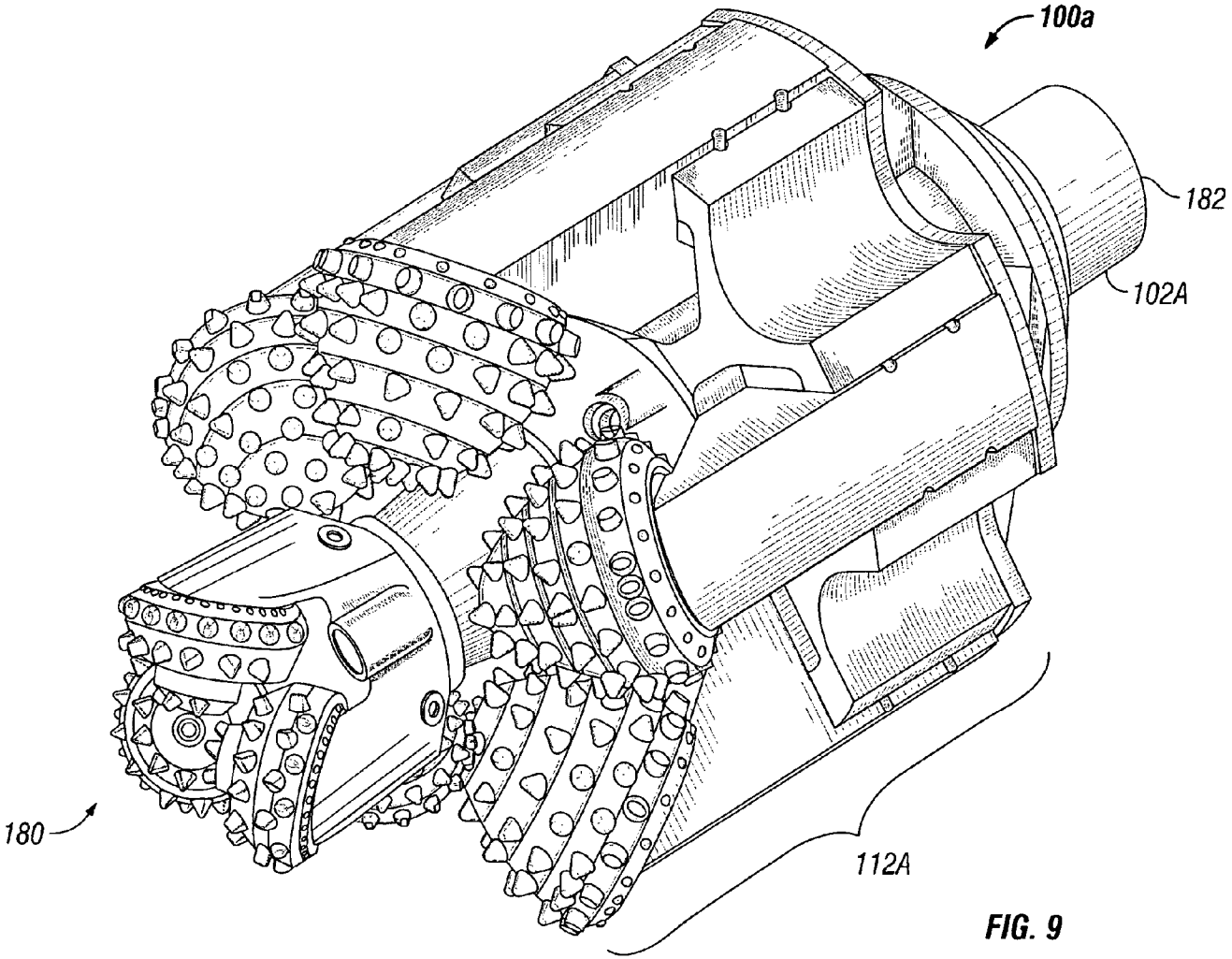
FIG. 9 is a perspective-view drawing of a back reamer assembly with attached pilot drill bit in accordance with an embodiment of the present invention.

Referring now to FIG. 9, a back reamer assembly 100A is shown. Back reamer assembly 100A is similar to back reamer assembly 100 of FIGS. 1–7 with the exception that in place of a rotary drill string connection (128 of FIG. 2) there is a pilot bit assembly 180. Using back reamer assembly 100A, pilot bit assembly 180 can be used to drill or enlarge a pilot bore immediately before cutting leg assemblies 112A enlarge that pilot bore. As such, back reamer assembly 100A would be driven rotationally and axially from formerly distal end 182 of drive stem 102A by a drill string (not shown).

Figure 10:
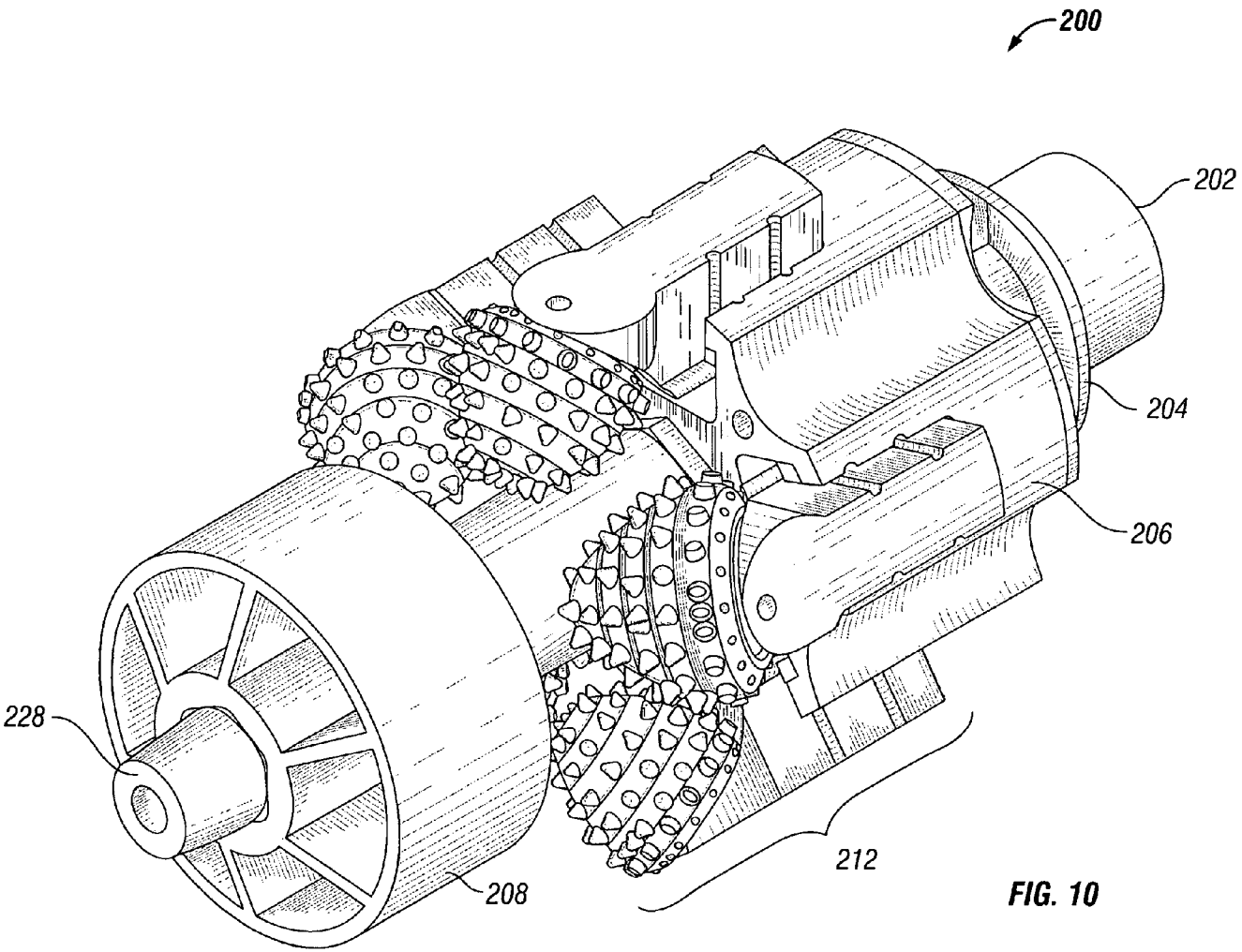
FIG. 10 is a perspective-view drawing of a back reamer assembly with integral hydraulics in accordance with an embodiment of the present invention.
Figure 11:
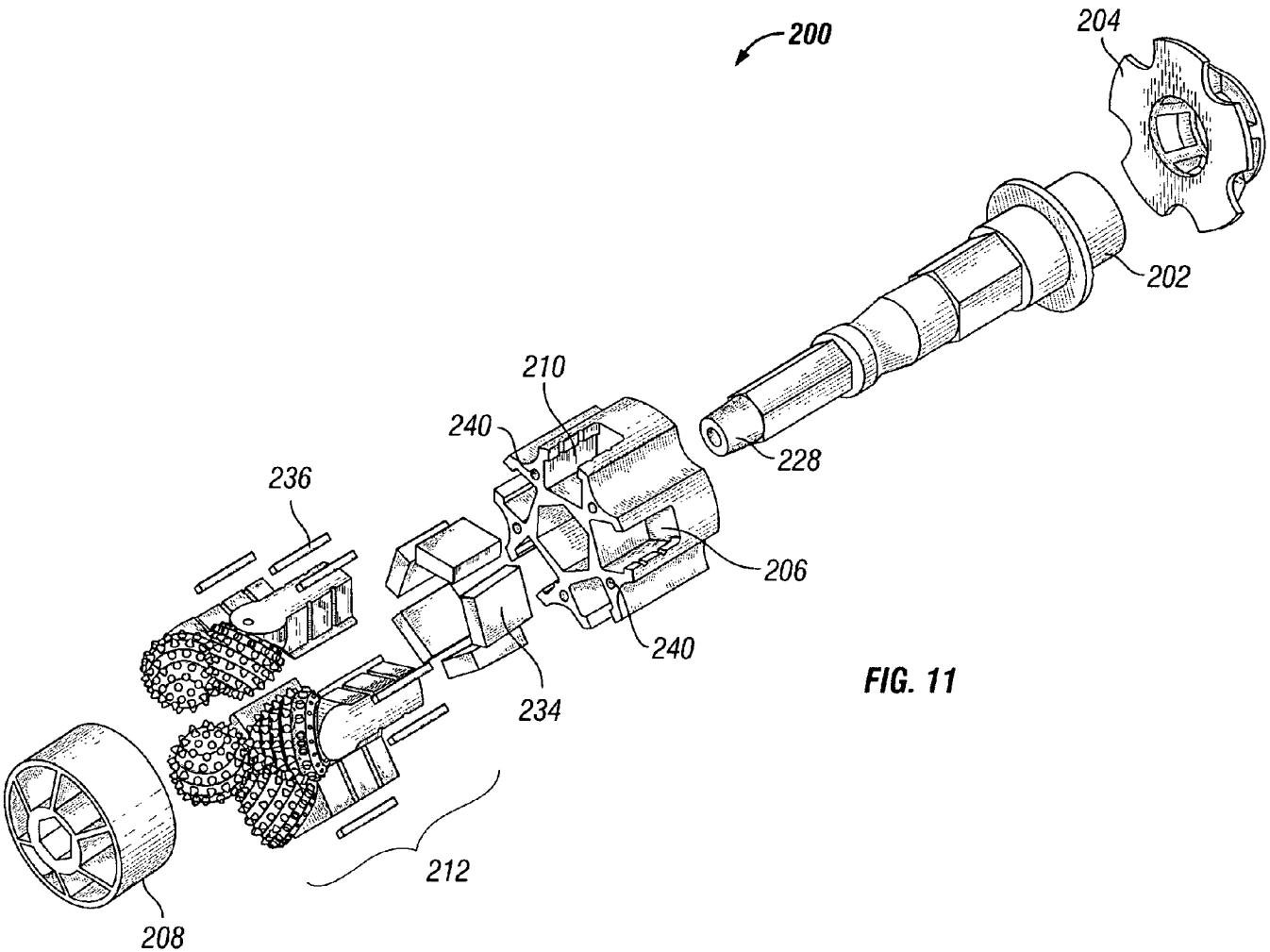
FIG. 11 is an exploded-view drawing of the back reamer assembly of FIG. 10.

Referring now to FIGS. 10 and 11, a back reamer assembly 200 in accordance with an embodiment of the present invention is shown. Back reamer assembly 200 is similar to back reamer assembly 100 of FIGS. 1–7 with the exception that the functions of hydraulic hub (130 of FIGS. 6 and 7) are incorporated into main body 206. Therefore, back reamer assembly 200 includes a drive stem 202, a support plate 206, the aforementioned main body 206, a centralizer 208, and a plurality of cutting leg assemblies 212. As before, cutting leg assemblies 212 are received within receptacles 210 of main body 206 and positioned and secured at a predetermined radial height by base shims 234 and upper shims 236. As there is no hydraulic hub mounted upon drive stem 202, a plurality of fluid nozzles 240 direct drilling fluids from the bore of the drill string to cutting leg assemblies 212.

Figure 12:
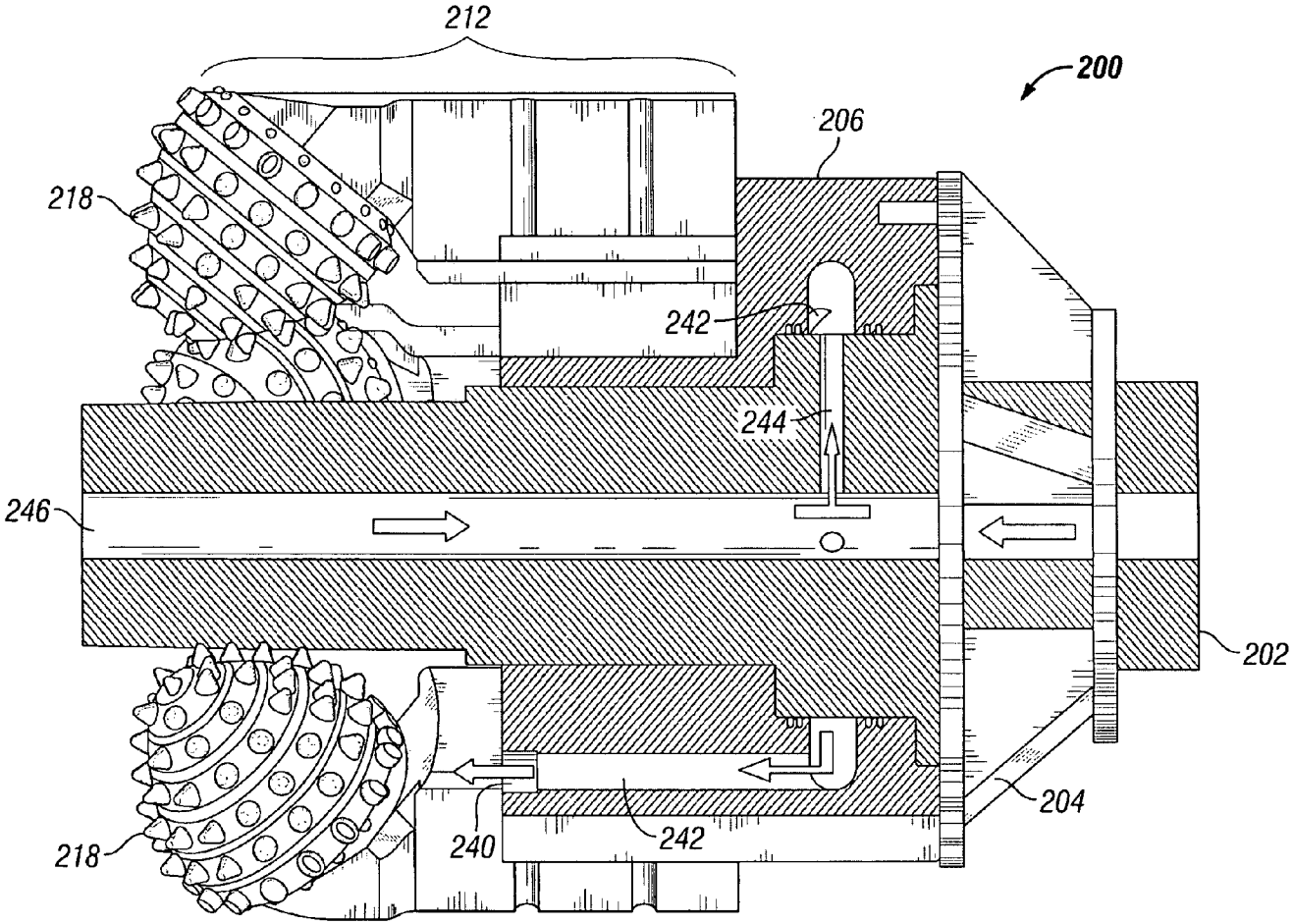
FIG. 12 is a section-view drawing of the back reamer assembly of FIG. 10.

Referring now to FIG. 12, the flow of drilling fluids through back reamer assembly 200 is shown. Particularly, the drill string (not shown) is connected to back reamer assembly 200 at tool joint (228 of FIGS. 10 and 11) at the end of drive stem 202. As such, the bore of the drill string containing drilling fluids is connected to bore 246 of drive stem 202. Drive stem bore 246 connects through a fluid port 244 to a series of fluid passageways 242 within main body 206. Fluid nozzles 240 located at the end of fluid passageways 242 in main body 206 direct drilling fluids to cutting elements 218 of cutting leg assemblies 212. While fluid nozzles 240 are depicted as mere openings in main body 206, is should be understood that nozzles 240 can include structured nozzle components constructed to divert fluids in any direction necessary to properly cool, clean, or lubricate cutting leg assemblies 212. One benefit of back reamer assembly 200 over back reamer assembly 100 of FIGS. 1 and 2 is the reduced stress and improved fatigue strength of drive stem 202. By placing fluid port 244 behind the portion of the drive stem 202 that transmits torque from the drive stem 202 to the main body 206, stress concentrations are reduced.

Figure 13:
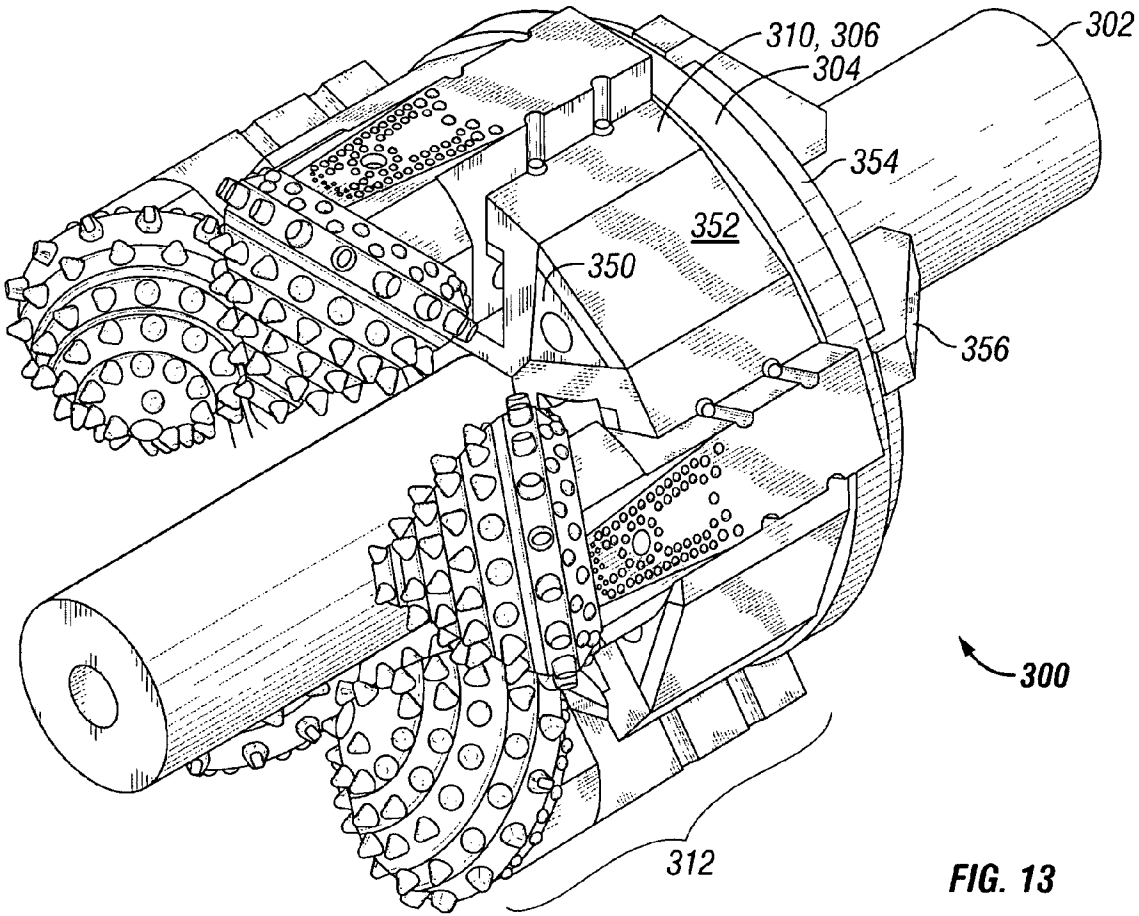
FIG. 13 is a perspective-view drawing of a back reamer assembly in accordance with an embodiment of the present invention.
Figure 14:
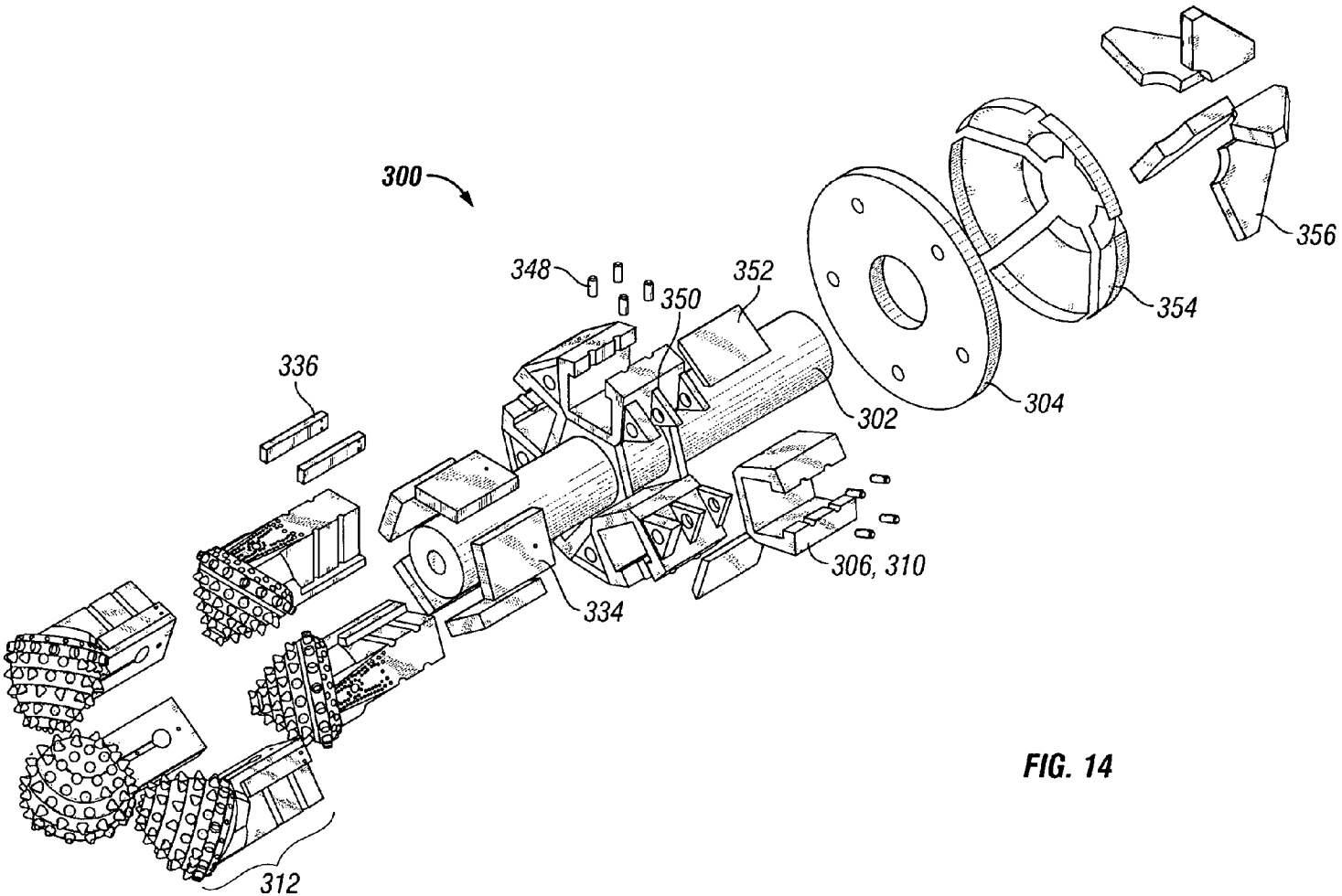
FIG. 14 is an exploded-view drawing of the back reamer assembly of FIG. 13.

Referring now to FIGS. 13 and 14, a back reamer assembly 300 in accordance with an embodiment of the present invention is shown. Back reamer assembly 300 is constructed as a fabrication that is welded together from multiple components to form a drive stem 302 and main body 306 that acts as a single solid unit. As such, drive stem 302 is shown constructed from a round pipe with main body 306 constructed from a plurality of plate steel components 350 and 352 welded to drive stem 302. Similarly, a support plate 304 is welded behind main body 306 and includes welded braces 354 and 356 to ensure torsional and axial loads are transmitted from drive stem 302 to main body 306. Furthermore, a plurality of receptacles 310 are welded to drive stem 302 to form main body 306. As described above in reference to other embodiments for back reamer assemblies (100, 200), cutting leg assemblies 312 are configured to be radially extendable and retractable within receptacles 310 with the radial position of cutting leg assemblies defined and maintained by base shims 334 and upper shims 336. Furthermore, a plurality of taper pins 348 reduce the amount of tangential movement of cutting leg assemblies 312 within receptacles 310. As a substantially welded assembly, back reamer assembly 300 is not as "modular" as back reamer assemblies (100, 200) described above. However, cutting leg assemblies 312 are radially adjustable within receptacles 310 and are swappable, so some modularity remains. Furthermore a centralizer (not shown) may be attached to drive stem 302 through permanent (welding) or temporary attachment mechanisms, preserving yet another element of modularity of back reamer assembly 300. While not as modular as assemblies 100 and 200, back reamer assembly 300 still maintains some modularity over back reamer assemblies of the prior art.

Referring now to FIGS. 15–20 various retaining mechanisms for securing a cutting leg assembly 412 within a receptacle 410 adjacent to a support plate 404 at a particular radial height are disclosed. While the mechanisms disclosed in FIGS. 15–20 are shown in conjunction with receptacles 410 and cutting legs 412 similar in construction to those (310, 312) of welded back reamer assembly 300 of FIGS. 13 and 14, it should be understood that the retaining mechanisms disclosed are applicable to all back reamer assemblies in accordance with the present invention.

Figure 15:
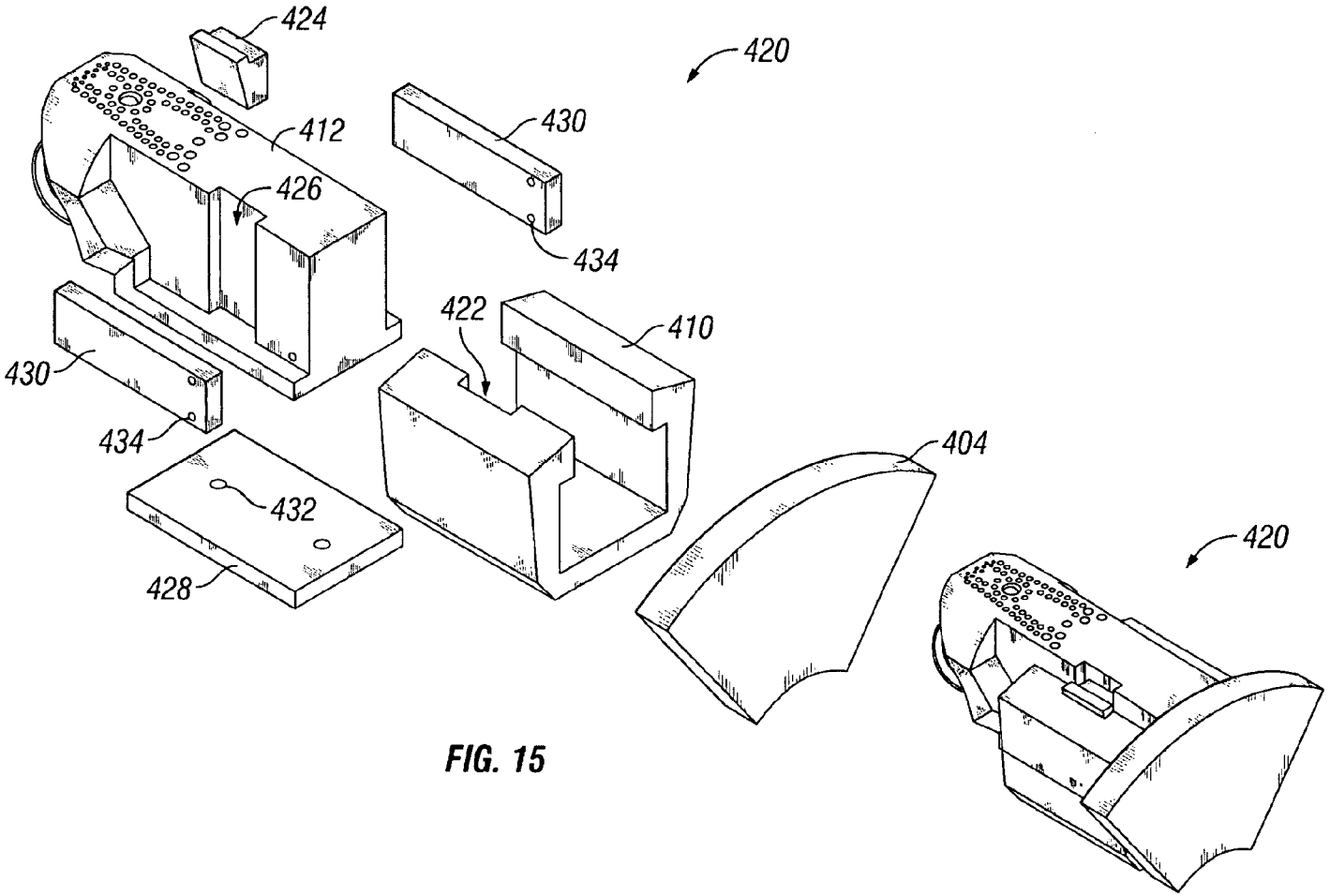
FIG. 15 is perspective-view drawing of a mechanism to retain a cutting leg assembly within a back reamer assembly in accordance with an embodiment of the present invention.

Referring now to FIG. 15, a mechanism 420 to secure and reduce vibrations of cutting leg assembly 412 within a receptacle 410 in accordance with an embodiment of the present invention is shown. Receptacle 410 is shown including a cutout 422 into which a wedge member 424 is inserted. Wedge member 424 can be of any design known to one of ordinary skill in the art, including, but not limited to single and double acting inclined plane surfaces. Furthermore, wedge 424 can be constructed as a plurality of taper pins engaged between cutting leg assembly 412 and receptacle 410. Therefore, cutting leg 412 is shown with a corresponding channel 426 to assist in receiving wedge 424. Furthermore, shims 428, 430 are shown with holes 432, 434 so that they may be secured to the sides and bottom of cutting leg assembly 412 with mechanical fasteners to prevent them from moving within receptacle 410.

Figure 16:
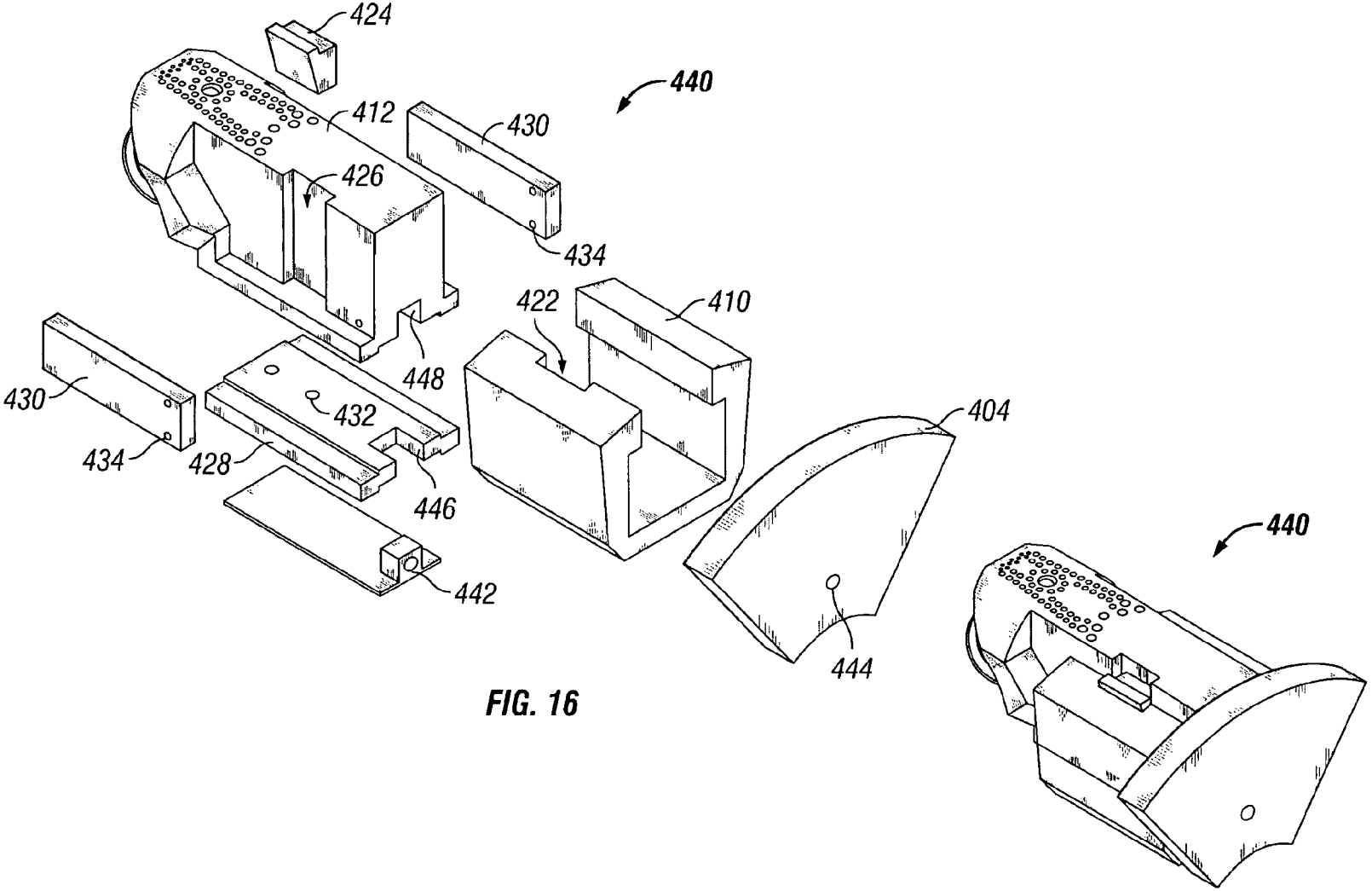
FIG. 16 is a perspective-view drawing of a mechanism to retain a cutting leg assembly within a back reamer assembly in accordance with an embodiment of the present invention.

Referring now to FIG. 16, a mechanism 440 to secure and reduce vibrations of cutting leg assembly 412 within receptacle 410 in accordance with an embodiment of the present invention is shown. In addition to the wedge member 424 described above, mechanism 440 includes a second wedge member 442 placed at the bottom side of shim 428 below cutting leg assembly 412. Second wedge member 442 will be activated by a mechanical fastener (not shown) extending through a hole 444 in support plate 404. Slots 446, 448 at the bottom of shim 428 and cutting leg assembly 412 will accommodate wedge 442. Wedges 424 and 442 effectively place cutting leg assembly 412 (with shims 428 and 430) into a bind within receptacle 410 to reduce vibrations therein.

Figure 17:
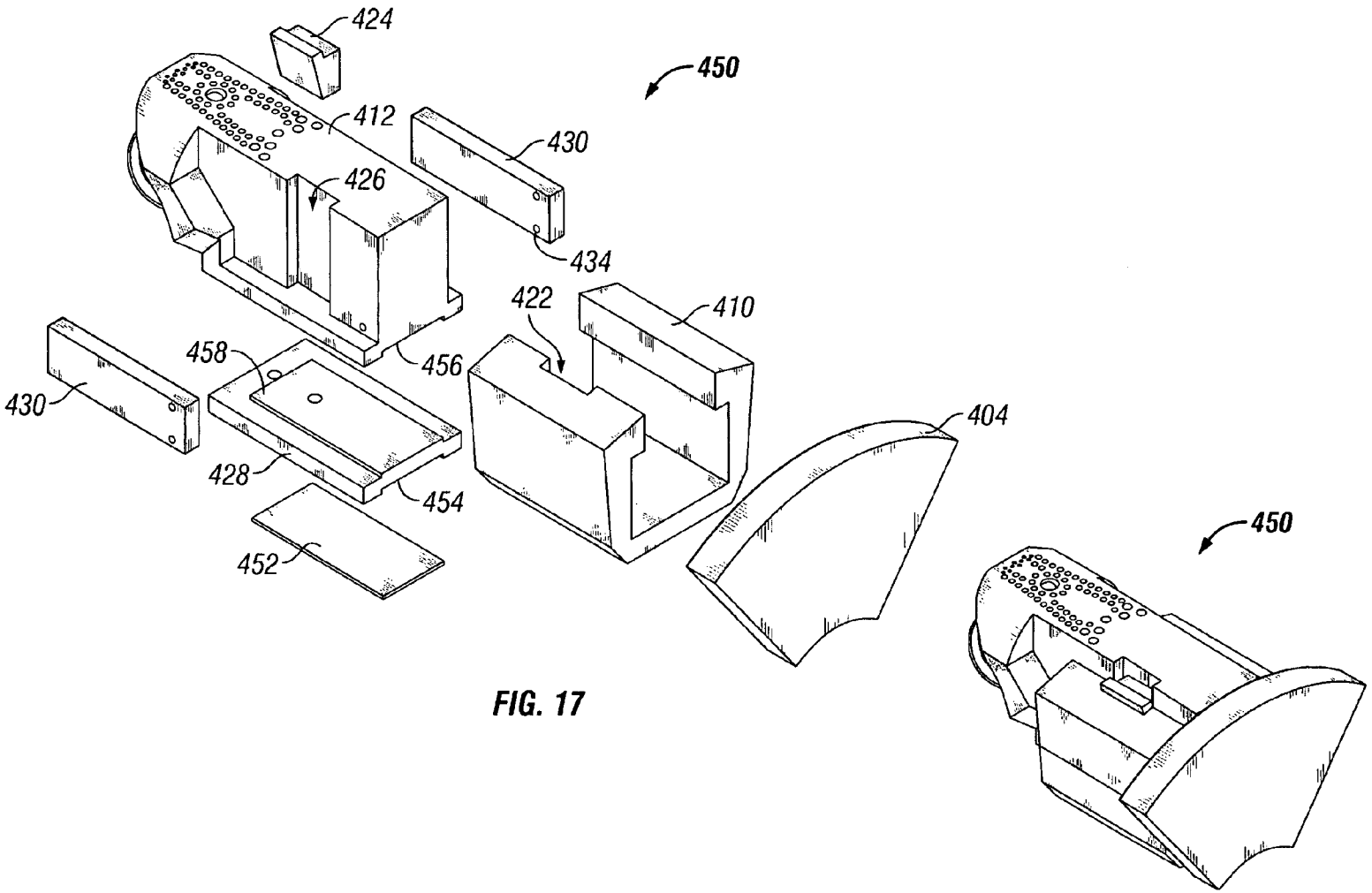
FIG. 17 is a perspective-view drawing of a mechanism to retain a cutting leg assembly within a back reamer assembly in accordance with an embodiment of the present invention.

Referring now to FIG. 17, a mechanism 450 to secure and reduce vibrations of cutting leg assembly 412 within receptacle 410 in accordance with an embodiment of the present invention is shown. In addition to the wedge member 424 described above, mechanism 450 includes a leaf spring 452 between shim 428 and the bottom of receptacle 410. A slot 454 provided at the bottom of shim 428 provides a location for leaf spring 452. Because cutting leg assembly 412 can be installed within receptacle 410 without shim 428, a slot 456 for receiving leaf spring 452 is machined therein as well. Therefore, to fill slot 456 of cutting leg assembly 412 when used in conjunction with shim 428, an upset portion 458 can be included at the upper end of shim 428 to engage slot 456 of cutting leg assembly 412. Leaf spring 452 provides bias between cutting leg assembly 412 and receptacle 410 that assists in reducing vibration therebetween.

Figure 18:
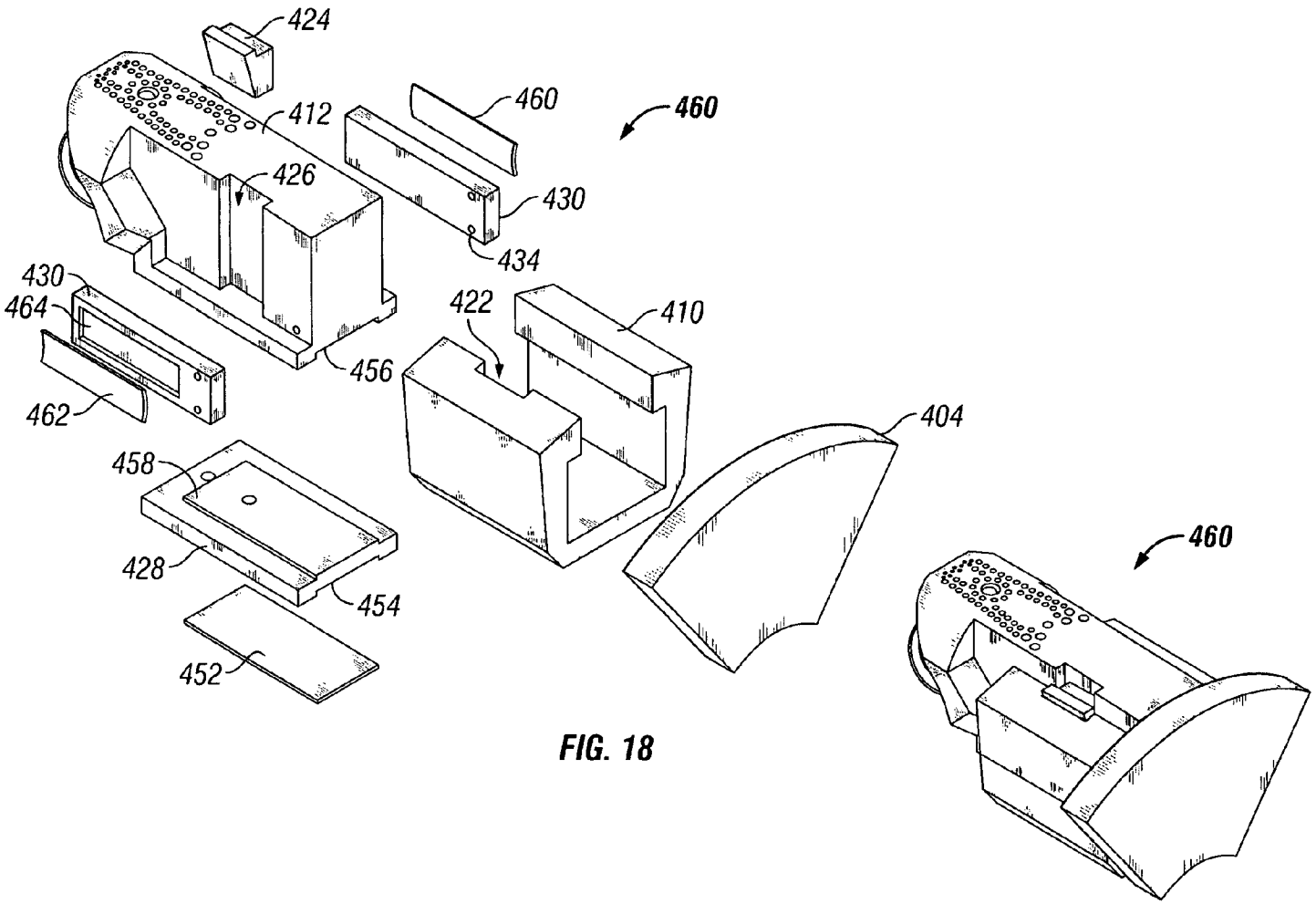
FIG. 18 is a perspective-view drawing of a mechanism to retain a cutting leg assembly within a back reamer assembly in accordance with an embodiment of the present invention.

Referring now to FIG. 18, a mechanism 460 to secure and reduce vibrations of cutting leg assembly 412 within receptacle 410 in accordance with an embodiment of the present invention is shown. In addition to wedge 424 and leaf spring 452 described above, mechanism 460 includes a pair of leaf springs 462 located between upper shims 430 and receptacle 410. Optionally, a slot 464 can be machined in each shim 430 to receive leaf springs 462. Once installed, leaf springs 462 in conjunction with shims 430 reduce vibrations of cutting leg assembly 412 within receptacle 410.

Figure 19:
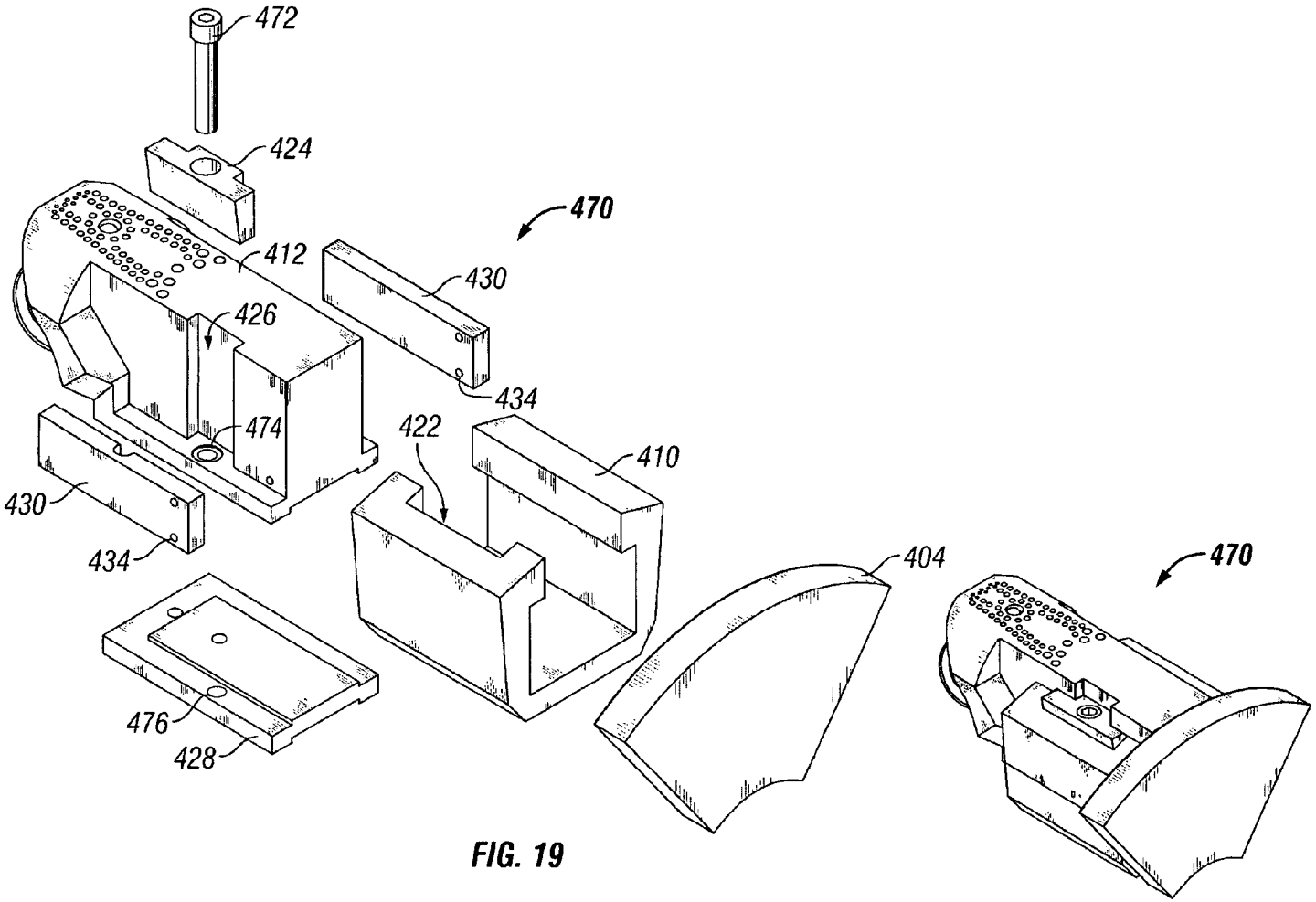
FIG. 19 is a perspective-view drawing of a mechanism to retain a cutting leg assembly within a back reamer assembly in accordance with an embodiment of the present invention.

Referring now to FIG. 19, a mechanism 470 to secure and reduce vibrations of cutting leg assembly 412 within receptacle 410 in accordance with an embodiment of the present invention is shown. Mechanism 470 adds a mechanical fastener 472 to wedge 424 to reduce vibrations and movement of cutting leg assembly 412 within receptacle 410. Fastener 472 threads into threaded holes 474 and 476 within cutting leg assembly 412 or shim 428. As such, wedge 424 is fixed to the side of cutting leg assembly 412 using fastener 472 such that cutting leg assembly 412 is clamped in position by the compressive load applied to wedge 424.

Figure 20:
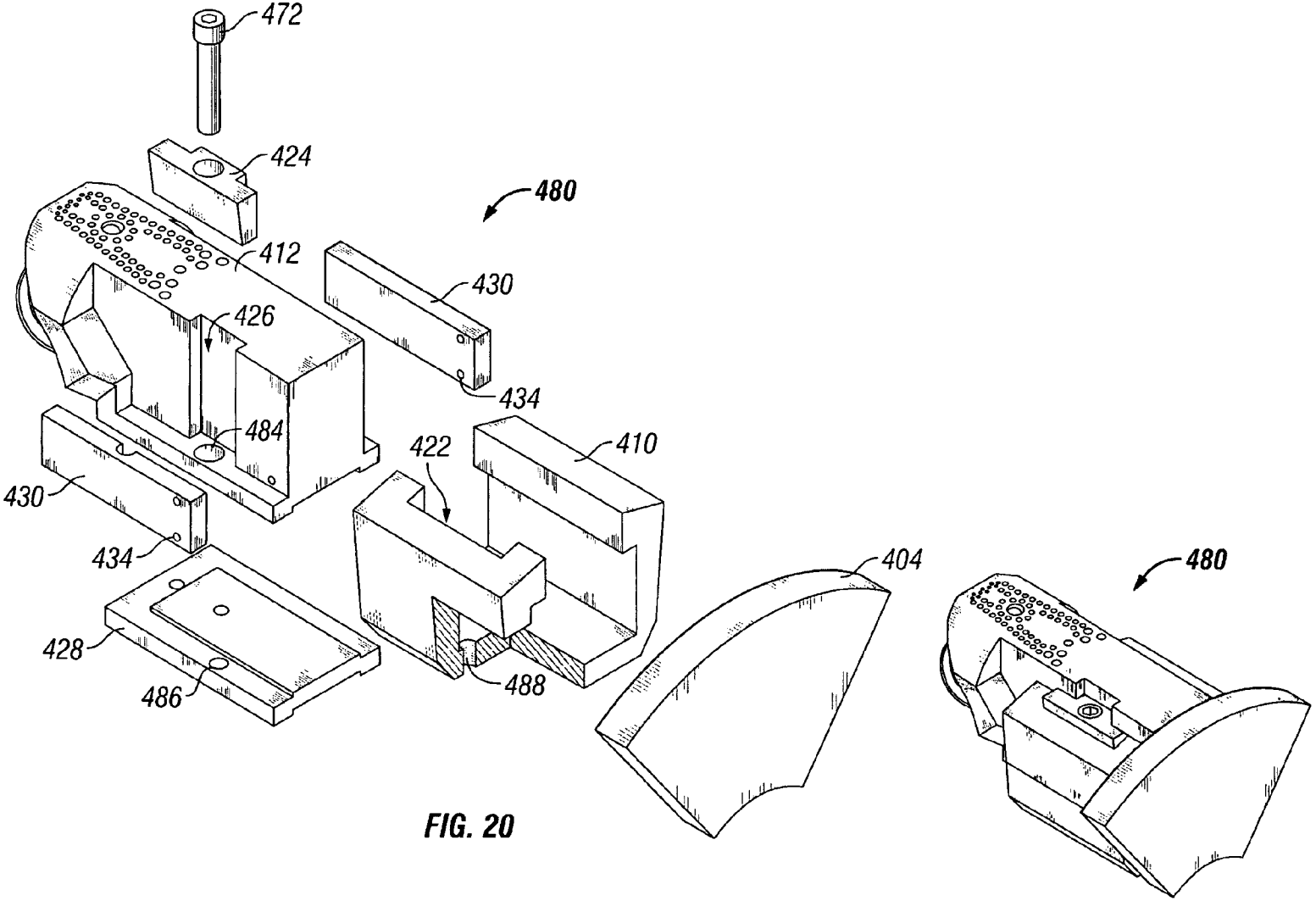
FIG. 20 is a perspective-view drawing of a mechanism to retain a cutting leg assembly within a back reamer assembly in accordance with an embodiment of the present invention.

Referring now to FIG. 20, a mechanism 480 to secure and reduce vibrations of cutting leg assembly 412 within receptacle 410 in accordance with an embodiment of the present invention is shown. Mechanism 480 includes mechanical fastener 472 described above, but instead of threading into holes (474 and 476 of FIG. 19) of cutting leg assembly 412 or shim 428, mechanical fastener 472 passes through clearance holes 484 and 486 and threads into a threaded hole 488 of receptacle 410. As discussed above, mechanism 480 fixes wedge 424 against a side of cutting leg assembly 412 such that cutting leg assembly 412 is clamped in position by the compressive load applied to wedge 424.

Figure 21:
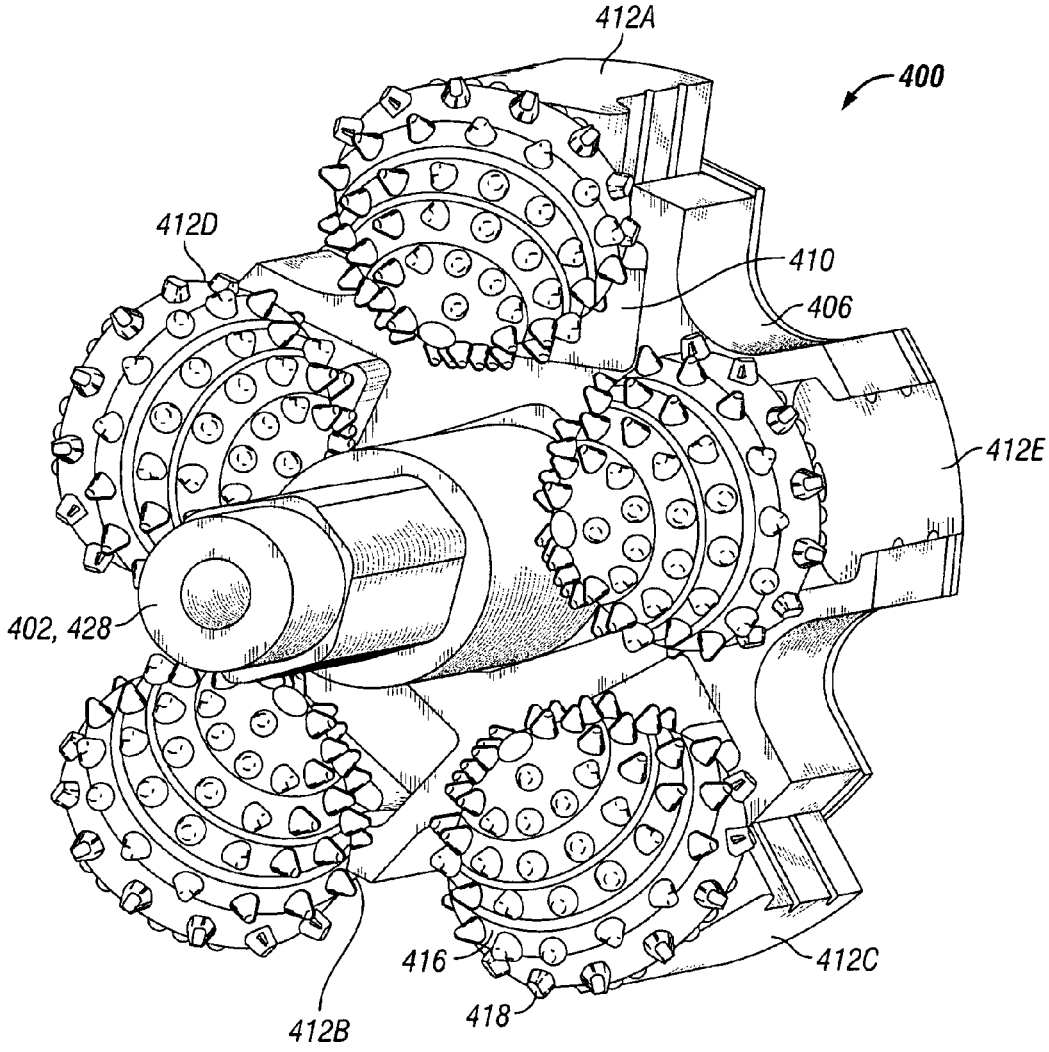
FIG. 21 is a perspective-view drawing of a back reamer assembly having differing cutting leg assembly heights in accordance with an embodiment of the present invention.

Referring now to FIG. 21, a modular back reamer assembly 400 having cutters at differing heights is shown. Back reamer assembly 400 includes a drive stem 402, a main body, and a plurality of cutting leg assemblies 412A–E. Each cutting leg assembly 412A–E includes a cutter head 416, a plurality of cutting elements 418, and is retained within a receptacle 410 of main body 406. A drill string (not shown) connects to a rotary connection 428 at a proximal end of drive stem 402. In FIG. 21, cutting legs 412A–E of modular back reamer assembly 400 are positioned at different radial distances from the center of drive stem 402 to increase the cutting path (i.e. the cutting width) of the reamer.

Figure 22:
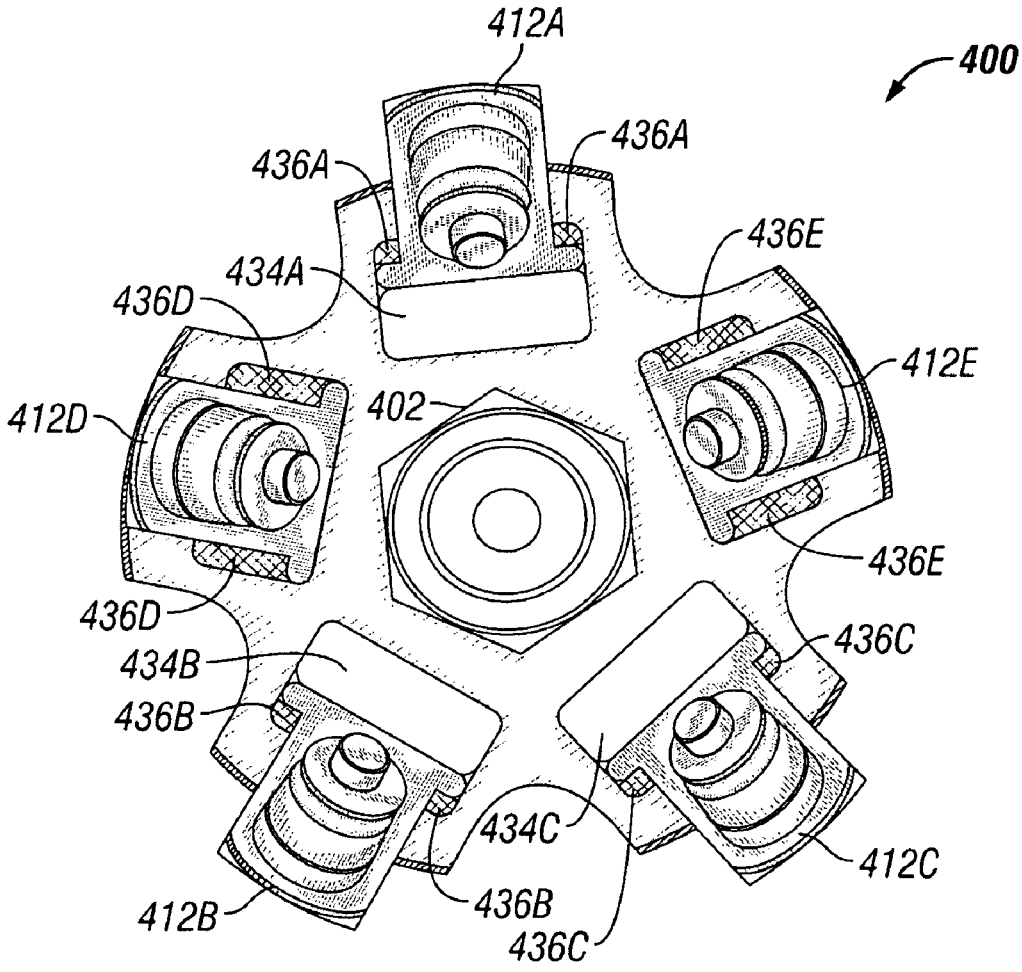
FIG. 22 is an end-view drawing of the back reamer assembly of Figure with cutter bodies removed to show the differing heights of the cutting leg assemblies.

Referring now to FIG. 22, modular back reamer assembly 400 is shown with cutter heads (416 of FIG. 21) removed so that the relative radial positions of cutting leg assemblies 412A–E can be viewed. In FIGS. 21–22, cutting leg assemblies 412A, 412B, and 412C are depicted at an increased radial distance from the center of drive stem 402 than cutting leg assemblies 412D and 412E. As such, cutting leg assemblies 412A, 412B, and 412C have thicker base shims 434A, 434B, and 434C than cutting leg assemblies 412D and 412E. Particularly, cutting leg assemblies 412D and 412E are depicted in FIG. 22 without base shims at all. Therefore, it likely follows that cutting leg assemblies 412A, 412B, and 412C have smaller upper shims 436A, 436B, and 436C than cutting leg assemblies 412D and 412E. Because cutting leg assemblies 412D and 412E have a lower radial height, their upper shims 436D and 436E are taller than those (436A, 436B, and 436C) of the remaining cutting leg assemblies.

By this arrangement, a cutting path wider than that possible by using all the cutting leg assemblies at equal radial distances from the drive stem is achieved. Generally, the widest cutting path may be obtained by placing some cutting leg assemblies at the farthest distance from a central axis of the back reamer and the remaining cutting leg assemblies at the shortest distance. Additionally, a combination of cutting leg assemblies of different types and sizes may be mounted to achieve the desired cutting results. Furthermore, rotating cones and fixed cutter-type cutter bodies can be mounted on the same leg assembly but at different radial positions.

While particular embodiments and combinations of embodiments are shown, it should be understood that any combination of the retaining mechanisms described herein may be employed to retain cutting leg assemblies in a particular radial position within receptacles of back reamer assemblies. As such, any combination of shims, leaf springs, taper pins, wedges, or mechanical fasteners may be employed to reduce vibration and tangential movement. Advantageously, embodiments of the present invention disclosed herein allow a broader range of back reamer configurations to may be rapidly built than was previously possible. Particularly, by stocking a few drive stems, centralizers, main bodies, and cutter assemblies, an operator may quickly accommodate virtually any job quickly without long buildup times and without stocking a large inventory. Furthermore, some embodiments of the present invention allow the construction of a back reamer assembly with minimal or no welding, thus making such back reamer assemblies more durable and less susceptible to stress fracture failures downhole.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A modular back reamer to be used in subterranean drilling, comprising:

a drive stem connected to a drill string and configured to support a reamer body;

the reamer body providing a plurality of receptacles, wherein the receptacles are configured to retain a cutting leg assembly at varying heights within a predetermined range; and a plurality of shims engaged within the receptacles to position the cutting leg assemblies at a specified height within the predetermined range.

2. The modular back reamer of claim 1, further comprising cutter bodies rotatably connected to the cutting leg assemblies.

3. The modular back reamer of claim 2, wherein the cutter bodies comprise inserts selected from the group consisting of tungsten carbide insert cutting elements and milled tooth cutting elements.

4. The modular back reamer of clam 1, wherein the cutting leg assemblies comprise drag-type cutting elements.

5. The modular back reamer of claim 4, wherein the cutting elements are selected from the group consisting of polycrystalline diamond and natural diamond.

6. The modular back reamer of claim 1, wherein the drive stem transmits rotational force from the drill string to the reamer body through a polygonal interface therebetween.

7. The modular back reamer of claim 1, further comprising a hydraulic hub adjacent to the reamer body, wherein the hydraulic hub directs hydraulic fluids from a bore of the drill string to the cutter bodies.

8. The modular back reamer of claim 1, wherein the reamer body further comprises hydraulic ports to direct hydraulic fluids from a bore of the drill string to the cutter bodies.

9. The modular back reamer of claim 1, further comprising a centralizer to maintain alignment of the back reamer with a pilot bore.

10. The modular back reamer of claim 1, further comprising a pilot bit positioned at an end of the drive stem.

11. The modular back reamer of claim 1, wherein the reamer body and the cutting leg assemblies are interchangeable with alternate reamer bodies and alternate cutting leg assemblies to allow the modular back reamer to drill at varying heights of alternative predetermined ranges.

12. The modular back reamer of claim 1, wherein the shims are placed below and around the cutting leg assemblies in relation to the receptacles of the reamer body.

13. The modular back reamer of claim 1, wherein the shims comprise leaf springs to reduce movement of at least one cutting leg assembly within at least one receptacle.

14. The modular back reamer of claim 1, further comprising a wedge member between at least one cutting leg assembly and at least one receptacle.

15. The modular back reamer of claim 1, further comprising at least one taper pin between at least one cutting leg assembly and at least one receptacle.

16. The modular back reamer of claim 1, wherein the plurality of cutting leg assemblies have differing specified heights.

17. The modular back reamer of claim 1, wherein the plurality of cutting leg assemblies have the same specified heights.

18. The modular back reamer of claim 1, wherein the drive stem and the reamer body are constructed together as a single unit.

19. The modular back reamer of claim 1, wherein the drive stem and the reamer body are welded together.

20. The modular back reamer of claim 1, wherein the reamer body comprises a plurality of receptacles welded to the drive stem.

21. A modular back reamer to be used in subterranean drilling, comprising:

a drive stem having a load flange, a polygonal profile, and a connection to a drill string;

the load flange and polygonal profile configured to abut and receive a replaceable reamer body;

the replaceable reamer body providing a plurality of receptacles, the receptacles retaining a plurality of cutting leg assemblies;

a plurality of shims engaged within the receptacles adjacent the cutting leg assemblies to secure the cutting leg assemblies at specified cutting heights therein; and a centralizer upon the drive stem located adjacent the connection to a drill string, the centralizer configured to direct the modular back reamer's trajectory along a pilot bore.

22. The modular back reamer of claim 21, further comprising a hydraulic hub adjacent to the replaceable reamer body, wherein the hydraulic hub is configured to direct hydraulic fluids from a bore of the drive stem to the cutting leg assemblies.

23. The modular back reamer of claim 21, wherein the replaceable reamer body further comprises hydraulic ports to direct hydraulic fluids from a bore of the drill stem to the cutting leg assemblies.

24. The modular back reamer of claim 21, wherein the cutting leg assemblies are roller cone assemblies.

25. The modular back reamer of claim 21, wherein the cutting leg assemblies are scraper cutting assemblies.

26. The modular back reamer of claim 21, further comprising leaf springs adjacent to the plurality of shims.

27. The modular back reamer of claim 21, further comprising wedge members to restrict the movement of the cutting leg assemblies within the receptacles.

28. The modular back reamer of claim 21, wherein the plurality of cutting leg assemblies have the same specified cutting height.

29. A method to enlarge a pilot bore created in a formation through horizontal directional drilling into a final diameter, the method comprising:

selecting a drive stem having a first drilling range including the final diameter;

selecting a reamer body having a second drilling range including the final diameter;

selecting a plurality of cutting leg assemblies having a third drilling range including the final diameter;

installing shims and the cutting leg assemblies into receptacles of the reamer body to define a cutting gage equal to the final diameter;

attaching a centralizer ahead of the reamer body and cutting leg assemblies, the centralizer configured to engage the pilot bore; and applying rotational and axial force to the drive stem to engage and cut the formation along a trajectory of the pilot bore.

30. The method of claim 29, wherein the drive stem and the reamer body are constructed as a single component.

31. The method of claim 29, wherein the cutting leg assemblies comprise roller cone cutters.

32. The method of claim 29, wherein the cutting leg assemblies comprise scraping cutters.

* * * * *